US006962885B1

(12) United States Patent
Best

(10) Patent No.: US 6,962,885 B1
(45) Date of Patent: Nov. 8, 2005

(54) TRANSFER BELT FOR A PAPER MACHINE

(75) Inventor: Walter Best, Duren (DE)

(73) Assignee: Thomas Josef Heimbach Gesellschaft mit Beschrankter Haftung & Co., Duren (DE)

( * ) Notice: Subject to any disclaimer, the term of this patent is extended or adjusted under 35 U.S.C. 154(b) by 819 days.

(21) Appl. No.: 09/610,984

(22) Filed: Jul. 6, 2000

(30) Foreign Application Priority Data

Jul. 8, 1999 (EP) ..... 99113193
Apr. 6, 2000 (DE) ..... 200 06 376 U

(51) Int. Cl.[7] ..... B32B 9/00; B29D 9/00

(52) U.S. Cl. ..... 442/59; 264/45.4; 264/45.8; 264/46.2; 264/216; 427/201; 427/352; 427/353; 427/366; 210/504; 210/507

(58) Field of Search ..... 264/45.4, 45.8, 264/46.2, 216; 427/201, 352, 353, 366; 210/504, 507; 442/59

(56) References Cited

U.S. PATENT DOCUMENTS

| | | | | |
|---|---|---|---|---|
| 4,483,745 | A | 11/1984 | Wicks et al. | 162/205 |
| 6,017,583 | A | 1/2000 | Gass | 427/201 |

FOREIGN PATENT DOCUMENTS

| | | |
|---|---|---|
| EP | 0547816 | 6/1993 |
| EP | 0576115 | 12/1993 |
| EP | 0786551 | 7/1997 |

*Primary Examiner*—Glenn Caldarola
*Assistant Examiner*—Alexis Wachtel
(74) *Attorney, Agent, or Firm*—Liniak, Berenato & White, LLC

(57) ABSTRACT

A transfer belt for a paper machine has a substrate and a coating on at least one flat side. The coating has an inner layer and an outer layer adjacent thereto. The outer layer has a porous structure having cavities open toward the outer side.

21 Claims, 1 Drawing Sheet

TRANSFER BELT FOR A PAPER MACHINE

The invention concerns a transfer belt for a paper machine, having a substrate and having a coating on at least one flat side.

Modem paper machines are achieving higher and higher speeds. Speeds of more than 2000 m/min are expected in the next few years. At such high speeds, the paper web must not be unsupported at any point as it passes through the press and dryer sections. In the press section, complete support of the paper web is in most cases not provided by way of the press felts circulating therein. In order to guide the paper web even in those regions in which support is not provided (this applies in particular to the transition region to the drying section), so-called transfer belts are used, which guide the paper web through one or more presses of the press section together with the respective associated press felt and, after the press felt separates from the paper web, guide it to a point where the paper web, usually with the aid of a suction roll, separates from the transfer belt and is taken up by a dryer fabric circulating in the dryer section Examples of the guidance of transfer belts in the press section of a paper machine are evident from FIGS. 1 through 3 of EP-A 0 576 115.

The further Figures and associated description of this document describe a transfer belt that has a substrate, configured as a woven fabric, which ensures the structural strength of the transfer belt Provided on the flat side that is intended to support the paper web is a coating made of a polymer material, preferably an acrylic or polyurethane resin, into which the substrate fabric is partially embedded. On the other flat side, a fiber batt can be needle-felted onto the substrate.

A transfer belt must meet two contradictory requirements. On the one hand, the transfer belt must exert sufficient adhesive force on the paper web so that the paper web does not detach from the transfer belt in the region where the press felt lifts off. On the other hand, the adhesive force in the region where the paper web is lifted off from the transfer belt must be sufficiently low that separation is not impeded. In the case of the transfer belt defined in EP 0 576 115, an attempt is made to meet these requirements by roughening the surface provided for supporting the paper web. To explain the effect of the roughening, it is stated that the roughness of the surface decreases in the nip of a press, and consequently the surface becomes smoother so that a thin water film forms between the paper web and surface. This is said to result in a greater adhesive force between the two than between the paper web and press felt, with the result that the paper web follows the transfer belt after leaving the press nip. The adhesive force is said to be greater than the force toward the press felt, even though the latter exerts a slight vacuum due to expansion after the press nip. In addition, the vacuum force generated by the transfer belt because of its expansion is said to persist for longer than that proceeding from the press felt. Another consequence of this expansion, however, is said to be the fact that the roughness of the surface is restored, which causes a breakdown of the water film and thus a decrease in adhesive force. In addition, it is said to be possible that air is enclosed in the depressions of the surface of the transfer belt upon entry into the press nip, and becomes compressed. The compressed air is said to expand after the press nip, contributing to the breakdown of the water film and thus to the decrease in adhesive force. This could be further enhanced by regions of greater and lesser hydrophobicity and/or hydrophilicity.

Satisfactory adhesion of the paper web is nevertheless not achieved with the known transfer belt, so that when the press felt lifts off from the paper web, the latter is taken with it, i.e. the paper web separates from the transfer belt. Obviously the effects described in EP-A 0 576 115, which are intended to ensure adhesion of the paper web to the paper web, are not sufficient. This possibly has to do with the fact that the paper web, when viewed microscopically, rests only on the tips of the roughness elevations.

It is consequently the object of the invention to configure a transfer belt in such a way that good adhesion of the paper web is ensured, so that lifting off of the press felt does not result in separation of the paper web from the transfer belt.

According to the present invention, this object is achieved in that the coating has an inner layer and an outer layer, adjacent thereto, that has a porous structure having cavities open toward the outer side. The basic idea of the invention is thus to provide an at least two-layer configuration of the coating, the inner layer being intended preferably to be elastic and impermeable to liquid, and the outer layer to have a porous structure. It has been found that as a result, the adhesion of the paper web after leaving the press nip is substantially improved, and separation of the paper web from the transfer belt does not occur even at the point where the press felt lifts off.

This is evidently based on two mechanisms of action. On the one hand, a flat and smooth contact surface is provided to the paper web, interrupted only by the openings of the cavities. This improves adhesion and also promotes the formation of a liquid film which enhances adhesion. On the other hand, the cavities additionally generate a vacuum that counteracts the tendency of the paper web to detach. This results from the fact that the cavities are compressed upon entry into the press nip, and the water and air present in the cavities is pressed out to a very large extent; and that after leaving the press nip the cavities expand again and thereby generate suction forces which favor adhesion of the paper web to the transfer belt. In addition, these suction forces also help prevent rewetting of the paper web.

It has been found that the improved adhesion of the paper web to the transfer belt does not create problems upon separation of the paper web, since the suction rolls present in the paper machine develop sufficient suction forces to lift off the paper web and deliver it to another belt, for example to a dryer fabric. Correspondingly, the breakdown of the liquid film does not have the significance that was given to it in the design of the transfer belt according to EP-A-0 576 115, and that resulted in a surface configuration which, because of its roughness, promotes breakdown of the liquid film.

As regards the configuration of the substrate, it is advantageous in terms of the function of the transfer belt if it has a certain elasticity in the longitudinal direction, so that the elasticity of the inner layer is utilized in the longitudinal direction as well. The specific modulus of the substrate should preferably be $\leqq 70$ N/tex. In this context, a material that is elastic in the presence of tensile stresses of 4 to 8 daN/cm on the substrate in the width direction should be used. Materials such as PBT, PES, polyamide-6, polyamide-6,6, polyamide-6,10, polyamide-6,12, polyamide-11, polyamide-12, and PTT, adjusted for corresponding elasticity, are particularly suitable for this; these materials can also be combined with one another.

As is true of all belts for a paper machine, the substrate ensures the structural strength of the transfer belt. For this purpose, the substrate can be configured of threads for example in the form of a woven fabric, knitted fabric, or thread layer. Also suitable, however, are fiber batts of correspondingly strong configuration, for example in impregnated or compressed form; these should, if possible, have a uniform thickness. On the side on which the coating is applied, the surface should be smooth, e.g. ground in order to create a permanent join between substrate and coating, it is advantageous if the substrate is at least partially embedded into the coating. Complete embedding is also possible.

Natural rubber or an elastomer is possible as the material for the inner layer. Silicone elastomer, polyester elastomer, and polyurethane are particularly suitable. The hardness of the inner layer should preferably be between 85 and 95 Shore A.

Inorganic filler particles, for example $TiO_2$ or clay, can additionally be incorporated into the inner layer in order to influence its hardness. It is advantageous in terms of the function of the inner layer if it has a thickness tolerance of max. 100 $\mu$m. To achieve this kind of thickness tolerance, it can be correspondingly turned down and ground before application of the outer layer.

Possible materials for the outer layer are preferably polyurethane and/or silicone elastomer and/or polyester elastomer. When these or other plastic materials are used, the cavities can be created, in a manner known per se, by the fact that soluble particles are scattered onto and embedded into them, and can be dissolved out with a solvent to which the outer layer is resistant (cf. EP-A-0 786 551). Water-soluble particles in the form of salts such as NaCl, KCl, and/or $CaCO_3$ are, in particular, suitable for this purpose. The particles should have a diameter $\leqq 200$ $\mu$m in order to produce cavities of corresponding size.

In order to improve the abrasion resistance of the outer layer, it is proposed to equip it on its surface with a layer of nanoparticles. These particles, used hitherto in chemistry as pigments for color effects, cosmetics, and data storage films, and whose particle sizes lie in the nanometer range, effectively protect the outer layer from wear, in particular when the nanoparticles are made, for example, of $SiO_2$ or metals. The nanoparticles can be applied in a suspension made up of a water-alcohol mixture, the mixture then being evaporated off. The nanoparticles can locally be equipped with fluorocarbon chains in order to impart a hydrophobic character to surface areas of the outer layer and thereby to facilitate separation of the paper web from the transfer belt.

A further alternative for manufacturing the outer layer consists in using an electron beam-cured prepolymer emulsion. Suitable for this, in particular, are silicones or polyurethanes that are emulsified in a water-surfactant mixture that is evaporated off during electron beam curing.

Lastly, it is proposed according to the invention that the outer layer be made externally of materials that form regions of different hydrophilicity and hydrophobicity. Both are intended to facilitate separation of the paper web from the transfer belt; the regions and the differences in terms of hydrophilicity and hydrophobicity are to be arranged and configured so as to continue ensuring sufficient adhesion of the paper web even in the region where the press felt lifts off.

The invention is illustrated in more detail, with reference to schematically depicted exemplary embodiments, in the drawings, in which.

Figure 1:
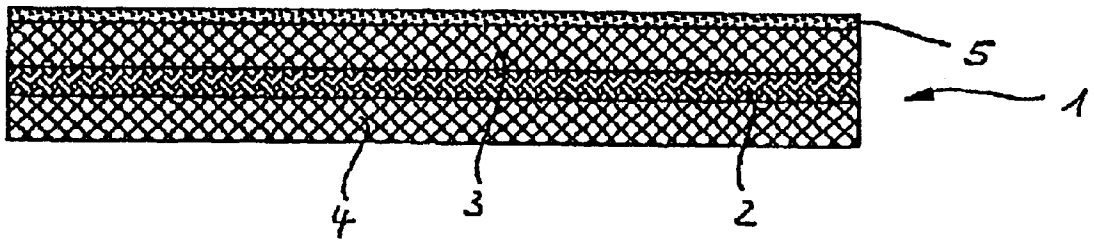
FIG. 1 shows a partial longitudinal section through a transfer belt for a paper machine.

Transfer belt 1 visible in FIG. 1 has a substrate 2 that in this case is made of a woven fabric using polyamide threads. Substrate 2 has on the upper side an inner layer 3 and on the lower side a base layer 4, substrate 2 being embedded in the two layers 3, 4. Inner layer 3 and base layer 4 are made of a silicone elastomer.

Applied onto the upper side of inner layer 3 is an outer layer 5 that has a porous structure and a smooth 6. Surface 6 is provided for the support of a paper web, whereas the lower side of base layer 4 runs over the rolls of a paper machine.

Figure 2:
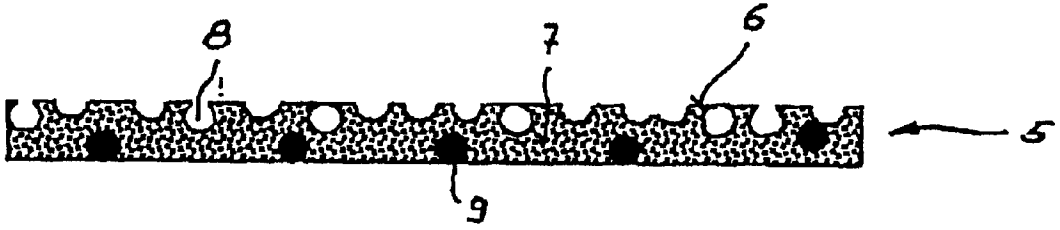
FIG. 2 shows a longitudinal section through a first embodiment of the outer layer of the transfer belt shown in FIG. 1.

In the exemplary embodiment shown in FIG. 2, outer layer 5 is made substantially of a cast polyurethane layer 7. In order to produce in this polyurethane layer 7 cavities (labeled 8 by way of example) open toward the outer side, salt particles (labeled 9 by way of example), uniformly distributed and with an average size <200 $\mu$m, were incorporated into the polyurethane material in homogeneously distributed fashion before application. After the formation of polyurethane layer 7 on inner layer 3, those salt particles 9 that were not completely surrounded by polyurethane layer 7, i.e. that communicated with the outer side, were washed out with water. This resulted in the creation of cavities 8 whose depth corresponds to the previous penetration depth of salt particles 9. Those salt particles that were incorporated at a distance from surface 6 were not dissolved out, and are therefore still present in polyurethane layer 7.

Cavities 8 interrupt surface 6, but there nevertheless remain, between the openings of the cavities, regions of surface 6 that lie in one plane and are interconnected and smooth. A large contact surface is thus offered to the paper web, thus creating a correspondingly large adhesion force. Because of their expansion after passing through the press nip, cavities 8 generate a negative pressure that enhances the adhesion of paper web to surface 6.

Figure 3:
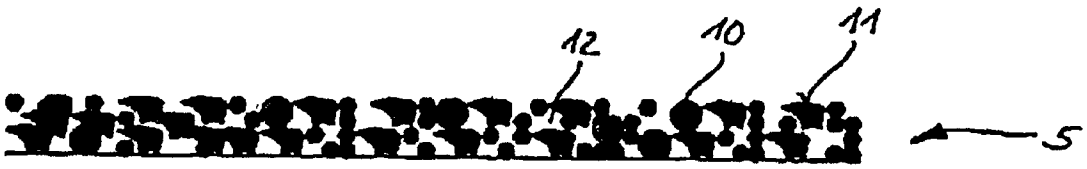
FIG. 3 shows a longitudinal section through a second embodiment of an outer layer of the transfer belt shown in FIG. 1.

In the exemplary embodiment of an outer layer 5 depicted in FIG. 3, the starting material is also polyurethane. Here, however, this material is applied in powder form and then sintered, so that here again a polyurethane layer 10 with a smooth surface 11 has formed. Salt particles were incorporated into the polyurethane powder (cf. in this connection the method described in EP-A 0 786 551), and were then completely dissolved out by way of a washing process, thus creating a porous structure with the formation of cavities (labeled 12 by way of example) open toward surface 11. The effect of polyurethane layer 10 is the same as in the case of polyurethane layer 7 shown in FIG. 2.

Figure 4:
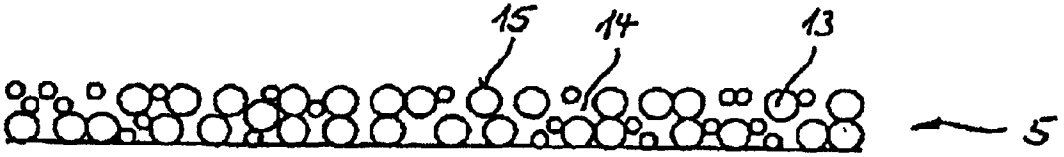
FIG. 4 shows a longitudinal section through a third embodiment of an outer layer of the transfer belt shown in FIG. 1.

The exemplary embodiment shown in FIG. 4 shows an outer layer 5 that was produced from an emulsion of prepolymers. This emulsion was applied onto inner layer 3 and then electron-beam cured This has created individual interconnected polymer particles (labeled 13 by way of example) between which cavities (labeled 14 by way of example) have formed. The overall result in this case as well is a porous structure having a comparatively smooth surface 15.

What is claimed is:

1. A transfer belt for a paper machine, having a substrate and having a coating on at least one flat side, wherein the coating has an inner layer and an outer layer having an outer side, adjacent thereto, said outer layer having a porous structure having cavities open toward the outer side.

2. The transfer belt as defined in claim 1, wherein the inner layer is impermeable to liquid.

3. The transfer belt as defined in claim 1, wherein the inner layer is longitudinally elastic.

4. The transfer belt as defined in claim 1, wherein the substrate has a specific modulus $\leqq 70$ N/tex in the longitudinal direction.

5. The transfer belt as defined in claim 4, wherein a material that is elastic in the presence of tensile stresses of 4 to 8 daN per cm of width of the substrate is used for the substrate.

6. The transfer belt as defined in claim 1, wherein the substrate is a woven fabric, knitted fabric, thread layer, or a fiber batt, or a combination thereof.

7. The transfer belt as defined in claim 1, wherein the substrate is at least partially embedded into the inner layer.

8. The transfer belt as defined in claim 1, wherein the inner layer is made of natural rubber or an elastomer, in particular silicone elastomer, polyurethane, and/or polyester elastomer.

9. The transfer belt as defined in claim 1, wherein the inner layer has a hardness between 85 and 95 Shore A.

10. The transfer belt as defined in claim 1, wherein the inner layer has inorganic filler particles.

11. The transfer belt as defined in claim 1, wherein the inner layer has a thickness, with a tolerance of less than or equal to 100 $\mu$m.

12. The transfer belt as defined in claim 1 wherein the outer layer is made of polyurethane and/or silicone elastomer and/or polyester elastomer.

13. The transfer belt as defined in claim 1, wherein the cavities in the outer layer have an average diameter of $\leqq 200$ $\mu$m.

14. A transfer belt for a paper machine, having a substrate and having a coating on at least one flat side, wherein the coating has an inner layer and an outer layer having an outer side, adjacent thereto, said outer layer having a porous structure having cavities open toward the outer side and wherein the outer layer is equipped on its surface with nanoparticles.

15. A transfer belt as defined in claim 14, wherein the nanoparticles are made at least partially of $SiO_2$.

16. The transfer belt as defined in claim 14, wherein the nanoparticles have flurocarbon chains.

17. A transfer belt as defined in claim 1, wherein the outer layer is made of an electron beam-cured prepolymer emulsion.

18. A transfer belt as defined in claim 1, wherein the outer layer is made externally of materials that form regions of different hydrophilicity and hydrophobicity.

19. The transfer belt as defined in claim 1 wherein the outer layer has a thickness of $\leqq 3$ mm and the inner layer a thickness of 1–3 mm.

20. The transfer belt as defined in claim 1, wherein the inner layer is compressively elastic.

21. The transfer belt as defined in claim 1, wherein the inner layer is longitudinally elastic and compressively elastic.

* * * * *